US006039541A

United States Patent [19]

Parker et al.

[11] Patent Number: 6,039,541

[45] Date of Patent: Mar. 21, 2000

[54] HIGH EFFICIENCY CEILING FAN

[75] Inventors: Danny S. Parker, Cocoa Beach, Fla.; Guan Hua Su; Bart D. Hibbs, both of Monrovia, Calif.

[73] Assignee: University of Central Florida, Orlando, Fla.

[21] Appl. No.: 09/056,428

[22] Filed: Apr. 7, 1998

[51] Int. Cl.[7] ..... F04D 29/38

[52] U.S. Cl. ..... 416/223 R; 416/5

[58] Field of Search ..... 416/5, 223 R

[56] References Cited

U.S. PATENT DOCUMENTS

| | | | |
|---|---|---|---|
| D. 355,027 | 1/1995 | Young . | |
| D. 382,636 | 8/1997 | Yang . | |
| 1,506,937 | 9/1924 | Miller | 416/223 R X |
| 1,903,823 | 4/1933 | Lougheed | 416/223 R X |
| 1,942,688 | 1/1934 | Davis | 416/223 R X |
| 2,283,956 | 5/1942 | Smith | 416/223 R |
| 2,345,047 | 3/1944 | Houghton | 416/223 R |
| 2,450,440 | 10/1948 | Mills | 416/223 R |
| 2,682,925 | 7/1954 | Wosika | 416/226 R X |
| 4,197,057 | 4/1980 | Hayashi | 416/242 |
| 4,325,675 | 4/1982 | Gallot et al. | 416/223 R |
| 4,411,598 | 10/1983 | Okada | 416/223 R |
| 4,416,434 | 11/1983 | Thibert et al. | 416/223 R X |
| 4,730,985 | 3/1988 | Rothman et al. | 416/223 R X |
| 4,782,213 | 11/1988 | Teal . | |
| 4,844,698 | 7/1989 | Gornstein et al. | 416/223 R |
| 4,892,460 | 1/1990 | Volk . | |
| 4,974,633 | 12/1990 | Hickey | 137/561 R |
| 5,033,113 | 7/1991 | Wang . | |
| 5,114,313 | 5/1992 | Vorus . | |
| 5,244,349 | 9/1993 | Wang | 416/5 X |
| 5,253,979 | 10/1993 | Fradenburgh . | |
| 5,951,162 | 9/1999 | Westman et al. | 416/223 R X |

FOREIGN PATENT DOCUMENTS

| | | | |
|---|---|---|---|
| 19987 | 1/1930 | Australia | 416/223 R |
| 1050902 | 1/1954 | France | 416/223 R |
| 676406 | 7/1952 | United Kingdom | 416/223 R |
| 925931 | 5/1963 | United Kingdom | 416/223 R |
| 92/07192 | 4/1992 | WIPO | 416/223 R |

*Primary Examiner*—John E. Ryznic

*Attorney, Agent, or Firm*—Brian S. Steinberger; Law Offices of Brian S. Steinberger

[57] ABSTRACT

Ceiling fan blades for low speed fan operation. The blades have a positive twist at the root motor portion of the blade and a slightly twisted rounded tip. The chord of the blades taper down from the root to the rounded tip, and have a tapered airfoil from the aft forward aft edge to the trailing edge. The airfoil has a combination of a rounded leading edge with sharp trailing edge, and a square leading edge and rounded trailing edge. The blades can be twenty inches in length and twenty-six inches in length, and be used in ceiling fans having two, three, four or more blades in a ceiling mount. The ceiling fan blades are optimized to operate in ceiling fans running at low speed ranges of approximately 50 to approximately 200 revolutions per minute(rpm) with an enhanced axial airflow which provide substantial energy savings and increased air flow over conventional flat planar ceiling fan blades.

16 Claims, 12 Drawing Sheets

Fig. 1: Air Flow Performance of Fans at Low Speed
(Prototype fan: 5° Pitch @ 24"; 9.75" below ceiling Fig. 2: Air Flow Performance of Fans at High Speed (Prototype fan: 5° Pitch @ 24"; 9.75" below ceiling SD7032 Airfoil - 6" at Root of Fan SD7032 Airfoil - 2.4" at Tip of Fan GM15 Airfoil - 6" at Root of Fan GM 15 Airfoil - 2.4" at Tip of Fan MA409 Airfoil - 6" at Root of Fan MA409 Airfoil - 2.4" at Tip of Fan Hibbs 504 Airfoil - 6" at Root of Fan Hibbs 504 Airfoil - 2.4" at Tip of Fan

HIGH EFFICIENCY CEILING FAN

This invention relates to ceiling fans, and in particular to a unique high performance fan blade having a twisted body, a tapered chord from root to tip and tapering air foil side portions from the aft(forward) edge to trailing edge and using the fan blade in a ceiling fan system.

BACKGROUND AND PRIOR ART

Overhead ceiling fans have been used for many years in to help move air in rooms. Traditional blades have usually centered around flat planar rectangular type shapes. See U.S. Pat. No. Des.355,027 to Young and U.S. Pat. No. Des.382,636 to Yang. Although both Young and Yang and 1995 and 1997 patents, respectively, both patents use technology similar to that from the turn of the century namely, flat planar type blades. None of these patents nor any ceiling fan technology known to the inventor, has optimized the ceiling fan blade shapes for optimum aerodynamic airflow. Furthermore, other known problems exist with the traditional flat planar rectangular ceiling fan blades. Traditional blades can be noisy at high speeds. These traditional blades have also been prone to vibration and wobbling during use.

Aircraft, boat and automobile engine propeller type blades have been altered over time to other shapes besides planar rectangles. See for example U.S. Pat. No. 4,411,598 to Okada; U.S. Pat. No. 4,730,985 to Rothman et al.; U.S. Pat. No. 4,794,633 to Hickey; U.S. Pat. No. 5,114,313 to Vorus; and U.S. Pat. No. 5,253,979 to Fradenburgh et al. However, all of these patents are used for high speed water and air craft and automobile engine applications where the propellers are run at high revolutions per minutes(r.p.m.) generally in excess of 500 r.p.m. None of these air craft and boat propellers are designed for optimum airflow at low speeds approximately 50 to approximately 200 r.p.m., which is the approximate r.p.m. used in overhead ceiling fans.

Some alternative shapes have been proposed for ceiling fan blades. See U.S. Pat. No. 4,892,460 to Volk. However, the Volk patent while claiming to be "aerodynamically designed" requires a curved piece to be attached by a groove to the side conventional planar rectangle blade. Using two pieces for each blade adds extreme costs in both the manufacturing and assembly of ceiling fan itself. Furthermore, the grooved connection point in the Volk devices would appear to be susceptible to separating and causing a hazard to anyone or any property beneath the ceiling fan itself. Such an added device also has necessarily less than optimal aerodynamic properties.

Thus, the need exists for solutions to the above problems in the prior art.

SUMMARY OF THE INVENTION

The first objective of the present invention is to provide ceiling fan blades that are aerodynamically optimized to move twice the air(double the airflow) as compared to conventional flat planar rectangular blades.

The second object of this invention is to provide ceiling fan blades that are more quiet and provide greater comfort as compared to conventional flat planar rectangular blades.

The third object of this invention is to provide ceiling fan blades that are less wobble prone as compared to conventional flat planar rectangular blades.

The fourth object of this invention is to provide ceiling fan blades that cut electricity costs in half over conventional flat planar rectangular blades.

The fifth object of this invention is to provide ceiling fan blades that can be made part of standard manufactured equipment with a smaller less expensive motor and still provide superior air flow to that achieved with larger more expensive motors and those with flat blades.

The sixth object of this invention is to provide ceiling fan blades that can be manufactured more cheaply than providing previously used larger motors used in previous larger ceiling fans.

The seventh object of this invention is to provide ceiling fan blades that can be combined with existing motors and be more energy efficient.

The eighth object of this invention is to provide ceiling fan blades between 64 to 72 inches that can mated with larger motors and provide superior air flow to traditional larger ceiling fan motors having large flat untwisted blades.

The ninth object of this invention is to provide a ceiling fan blades system with an alternative aesthetic appearance over conventional flat planar rectangular blades.

Preferred embodiments of the invention include blades having a length of approximately 20 or 26 inches, a positive twist adjacent to a rotor end of the blade, so that the blade pitch increases from a tip end of the blade to the rotor end of the blade, a tapered airfoil with a thin trailing edge providing high lift and low drag, and a tapered blade chord running from the rotor end to the tip end, wherein the blade is operated in a ceiling fan running at low speed ranges of approximately 50 to approximately 200 revolutions per minute(rpm), and provide substantial energy savings and increased air flow over conventional flat planar ceiling fan blades.

Further objects and advantages of this invention will be apparent from the following detailed description of a presently preferred embodiment which is illustrated schematically in the accompanying drawings.

DESCRIPTION OF THE PREFERRED EMBODIMENT

Figure 1:
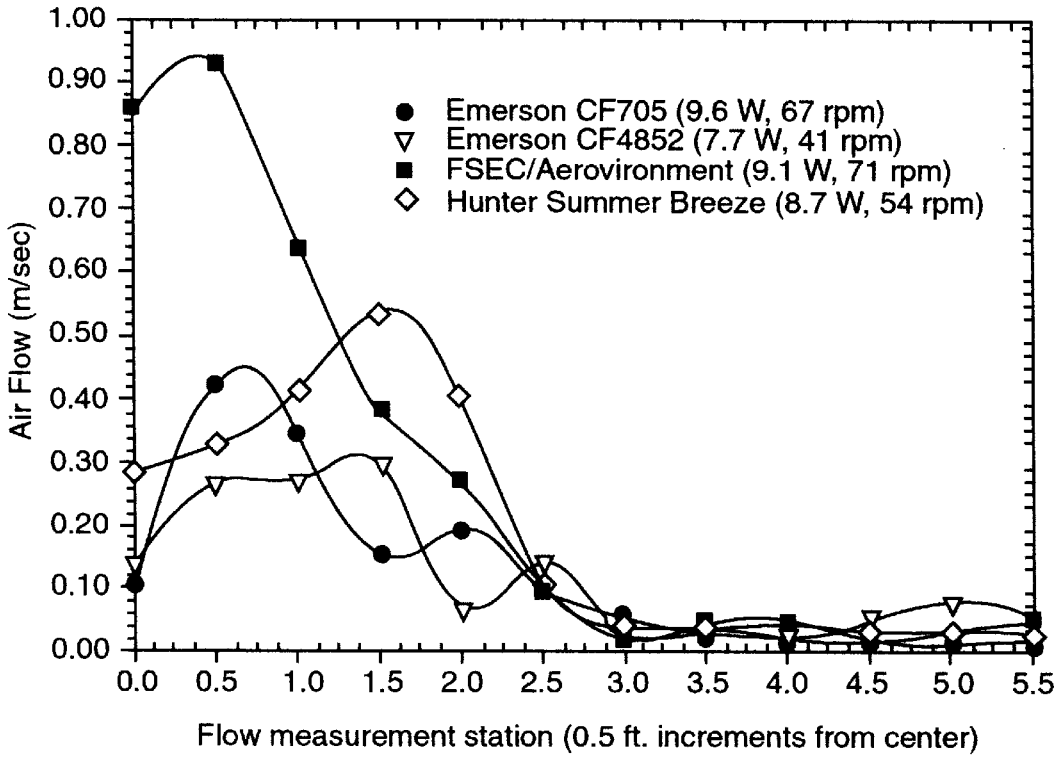
FIG. 1 is a graph of air flow performance of the novel invention fan blade and conventional ceiling fan blades operating at low speed.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

The novel ceiling fan blades of the subject invention were tested between May and June, 1997 at the Florida Solar Energy Center®(FSEC®). In the testing laboratory, a digital hot wire anemometer(Solomat MP 5000) was mounted on a tripod at a 56" height with an accuracy of 0.05% of full scale reading, a precision digital watt meter(Valhall 2100) was used with a resolution of 0.1 W, and a hand-held(Solomat) infrared tachometer was used to measure ceiling fan speed (rpm). Each of the tested fans attached to a ceiling. The novel fan blades were oriented with each pair having an overall span of approximately 52 inches. Besides the novel fan blades four conventional ceiling fans were tested and compared. A Hunter Fan Co. model "Summer Breeze" 21156 was tested. Emerson five blade fans model "Northwind" CF705, and model "Premium" CF4852 were tested. All the models had flat planar rectangular blades with widths of approximately 5" at the blade root up to 5.5" at the tip and are individually approximately 20" in length, that when assembled have a nominal tilt of approximately 12.5 degrees. The conventional blades had a surface area of approximately 103 square inches, were made of painted wood and had a measured weight of approximately 329 grams with mounting bracket hardware.

The fans were mounted with 3" down rods to 9' foot high ceilings so that ceiling to blade tip distance was approximately 9.25". The air flow measurements were made underneath the fans at a distance of approximately 56" from the floor and 41" from the fan blades. Testing was done by mounting each fan in turn and evaluating three parameters: air flow(meters per second(m/s)), power(watts) and speed (revolutions per minute(rpm)).

FIG. 1 shows the measured air flow in meters per second for the four differing fans operating at low speed of approximately 40 to approximately 75 rpm over the measuring region. The legends in brackets indicate the performance data of each fan in terms of motor power consumption and fan rpm. The horizontal axes of FIG. 1 represents the measurement readings at approximately 12 station locations immediately below the centerline of the fan and the others at six inch increments from the centerline. Since the fan blade and motors have a diameter of approximately 52", the first six stations comprise locations which cover the blade sweep. The remaining six stations(3–6 ft from the fan centerline) represent the fan air entrainment zone.

From FIG. 1, the novel subject invention is labelled as FSEC/Aerovironment fan which has a substantially higher air flow from the centerline to approximately 1.25 feet from the centerline beneath the fan. Both the subject invention and Emerson CF705 used the same motor an Emerson E77491, a 120 volt powered 0.37 Amp motor having a retail cost of approximately $70.00. The Emerson CF4852 uses a 0.89 Amp motor having a cost of approximately $183.00. The Hunter "Summer Breeze" 21156 uses a 0.65 Amp motor having a cost of approximately $79.00.

For FIG. 1, the four fans had operating parameters in Table 1. The Power Draw is the instantaneous electric power requirement measured in Watts.

TABLE 1

| FAN | POWER DRAW | REVOLUTIONS PER MINUTE(RPM) |
|---|---|---|
| Emerson CF705 | 9.6 Watts | 67 rpm |
| Emerson CF4852 | 7.7 Watts | 41 rpm |
| FSEC | 9.1 Watts | 71 rpm |
| Hunter Summer | 8.7 Watts | 54 rpm |

Note that the Emerson CF705 fan and the subject invention fan were using the same motor but had dramatically different performance results in FIG. 1 from an peak air flow of approximately 0.95 meters per second for the subject invention blades to 0.43 meters per second for the Emerson CF705 at the same 0.4 measurement station.

Figure 2:
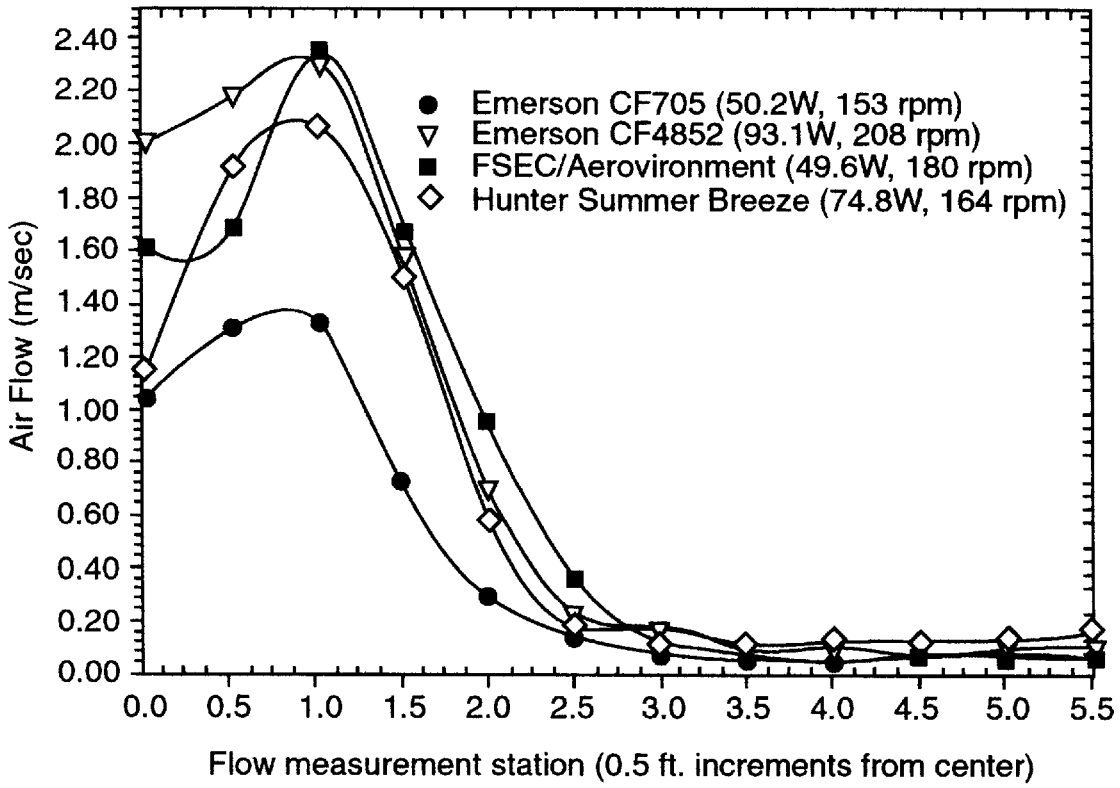
FIG. 2 is a graph of air flow performance of the novel invention fan blade and conventional ceiling fan blades operating at high speed.

FIG. 2 is a graph of air flow performance of the novel invention fan blade and conventional ceiling fan blades operating at high speed of approximately 150 rpm to approximately 210 rpm.

For FIG. 2, the four fans had operating parameters in Table 2. The Power Draw is the instantaneous electric power requirement measured in Watts.

TABLE 2

| FAN | POWER DRAW | REVOLUTIONS PER MINUTE(RPM) |
|---|---|---|
| Emerson CF705 | 50.2 Watts | 153 rpm |
| Emerson CF4852 | 93.1 Watts | 208 rpm |
| FSEC | 49.6 Watts | 180 rpm |
| Hunter Summer | 74.8 Watts | 164 rpm |

Note that the power of the fans are quite different except for the subject invention and the Emerson CF705 model which both had the same motor. From FIG. 2, it is clear that the Emerson CF4852 was the closest to the subject invention in air flow performance. However, the same air flow performance comes at a considerable increase in energy use. The CF4852 with its larger K55 electric motor uses 93.1 Watts as opposed to the 49.6 Watts used by the subject invention, a reduction in relative energy use of approximately 50% with similar air flow. The Hunter fan has the next best performance since its motor draws only 75 Watts at high flow.

The Emerson CF4852 pulls approximately twice the power (93.1 W vs. 49.6 W) as compared to the subject invention, FSEC fan blades model. For example, if each fan was operated an average of eight hours per day at high speed the Emerson CF4852 would cost approximately $22.00 per year to operate while the FSEC model would cost approximately $12.00. This cost savings becomes more substantial in residences and businesses that have multiple fans(i.e. most homes have five or more fans).

Note that FIG. 2 shows that all 52 inch fans only provided good air flow (>0.50 meters per second(m/s)) over the radius of the fan blades(2 feet shown at measurement location five). All increases to measured air flow are essentially negligible by the time measurement station seven is reached(3 feet from the fan). This outcome indicates that larger fan blades would increase fan coverage. The latter fact agrees with earlier recognized studies. See F. H. Rohles, S. A. Konz and B. W. Jones, 1983, "*Ceiling Fan as Extenders of the Summer Comfort Envelope,*" ASHRAE Transactions, Vol.89,Pt.1A., American Society of Heating, Refrigeration and Air Conditioning Engineers, Atlanta, GA.,p.51.

The measured air velocities(m/s) of FIGS. 1–2 between each measurement station were multiplied by the area of the specific area($m^2$) to yield a volumetric flow ($m^3$/s). The flows for each fan were then summed over the relative areas between air flow stations extending out to three feet from the fan center where the flows of all fans dropped to background values (>0.1 m/s). The total flows were then converted into cfm(cubic feet per minute) for each fan. An efficiency index was produced by dividing the total cfm per fan by the measured motor wattage(cfm/W). Table 3 provides the results for low fan speed. Table 4 shows the results for high fan speed.

TABLE 3

Comparative Fan Performance and Efficiency at Low Speed of approximately 40 rpm to approximately 70 rpm.

| Value | Emerson CF705 | Emerson CF4852 | Hunter SUMMER BREEZE | FSEC |
|---|---|---|---|---|
| CFM | 1087 | 1001 | 1865 | 1907 |
| Watts | 9.6 | 7.7 | 8.7 | 9.1 |
| CFM/W | 113 | 130 | 214 | 210 |

The Emerson CF705 and FSEC invention fans use the same identical motor, so the improvement in performance is solely a reflection of the change in the efficiency of the propeller blades. The air moving efficiency(measured in cfm/Watts) of the Emerson motor is increased by 86% nearly doubling the overall performance.

Both the Emerson CF4852 and Hunter 21156 use different motors, although motor draws are similar. The low speed performance of the Hunter Fan is similar to the subject invention, mainly due to the fact that its air flow is highest towards the edge of the ceiling fan blade tips which encompasses a larger area.

Table 4 shows the relative performance for each fan at high speed of approximately 150 rpm to approximately 210 rpm.

TABLE 4

Comparative Fan Performance and Efficiency at High Speed

| Value | Emerson CF705 | Emerson CF4852 | Hunter SUMMER BREEZE | FSEC/Aero Vironment |
|---|---|---|---|---|
| CFM | 3110 | 6057 | 5339 | 6471 |
| Watts | 50.2 | 93.1 | 74.8 | 49.6 |
| CFM/W | 61.9 | 65.1 | 71.4 | 130.5 |

At high speed, the disparity between the subject invention and the conventional models is more dramatic. Keeping in mind that the only difference between the FSEC version and the Emerson CF705 model is the novel invention blades (they both use the same motor), the invention shows an approximate 111% increase in air moving efficiency. Not only does the FSEC invention blades have the greatest air moving efficiency, but it also has the greatest absolute flow, even more than the Emerson model using a motor which draws 88% more power.

The novel subject ceiling fan blades can be manufactured more cheaply than providing previously used larger motors used in previous larger ceiling fans. Larger 100 Watt motors used in the Emerson CF4852 are approximately $100 in cost higher than the motors used in the Emerson CF705 and the motor used with the subject invention blades. Using the novel subject fan blades can save approximately $1 to approximately $15 per year for each fan operation. The basis for the calculations assumes fans are used approximately 4 to approximately 8 hours per day with differing power draws of approximately 5 to approximately 45 Watts depending on fan speed. Electric rates can range from $0.07 to $0.12 kwatts per hour.

The novel subject invention ceiling fan blades can be combined with existing motors and be more energy efficient. Approximate retail costs of using the novel blades with a small motor can be approximately $50 to approximately $100 lower than the retail costs of using the larger fan motor in the Emerson K55 motor and have similar operating air flow performance. Furthermore, the improved air flow performance can produce additional savings through reduced needs for air conditioning to achieve comfort, or choice of lower motor speeds for operation.

When mated with a larger fan motor(Emerson K55), a larger version of the current fan blades(covering approximately 64 to approximately 72 inches) can provide superior air flow to conventional motors that traditionally use flat untwisted blades.

Figure 3:
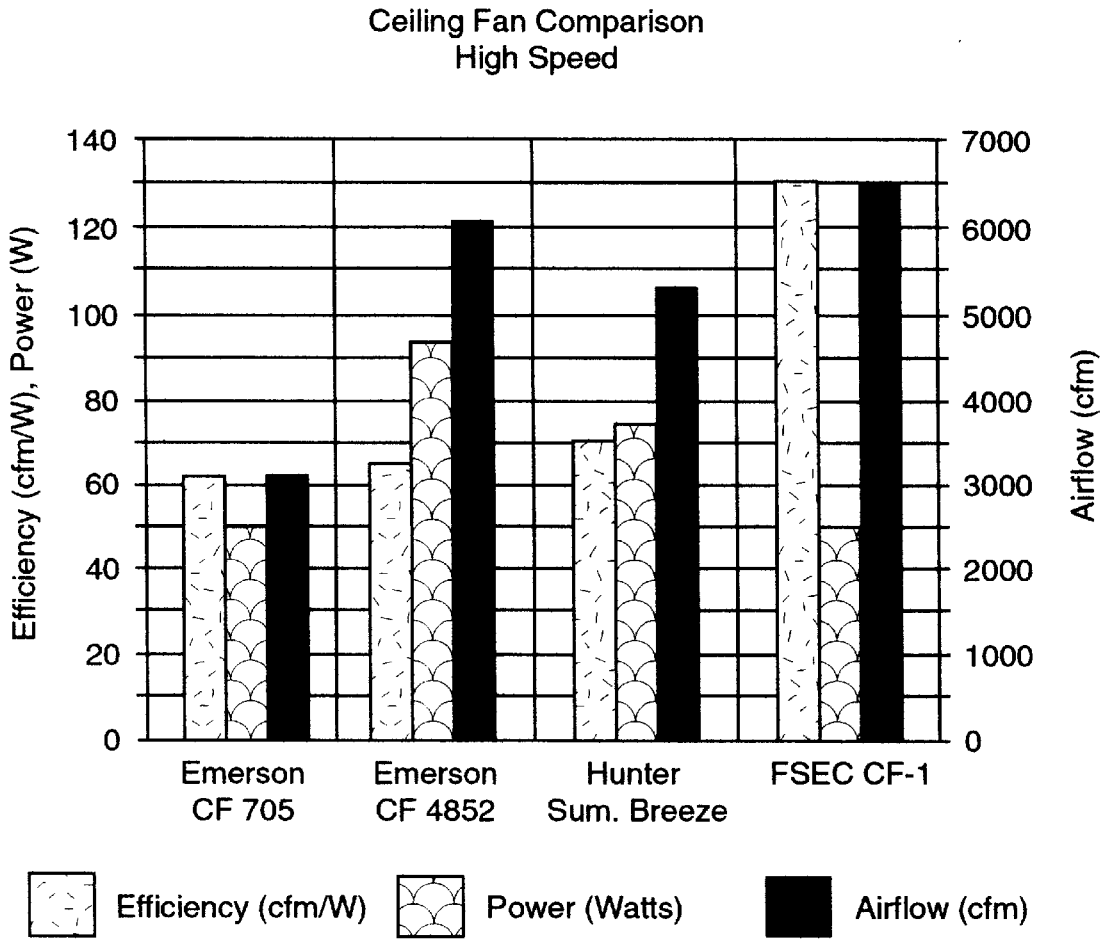
FIG. 3 is a bar graph of ceiling fan comparison of the novel invention fan blade and conventional ceiling fan blades operating at high speed.

FIG. 3 is a bar graph of ceiling fan comparison of the novel invention fan blade and conventional ceiling fan blades operating at high speed. Each of the right-hand bars shows the total produced air flow in cfm for each fan. Note that the FSEC fan evidences the best performance. The middle bar shows electric power draw. Again, the FSEC fan uses the least power. Finally, the left-hand bar (efficiency) shows how many cfm of air is moved per Watt. None of the fans are close to the FSEC performance.

Figure 4B:
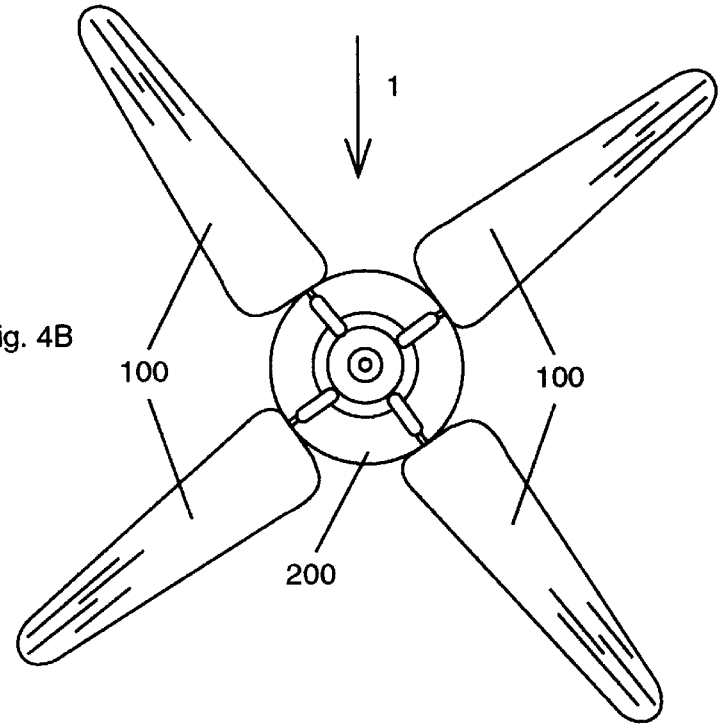
FIG. 4B is a bottom view of the novel fan blades and motor mount of FIG. 4A along arrow A.
Figure 4A:
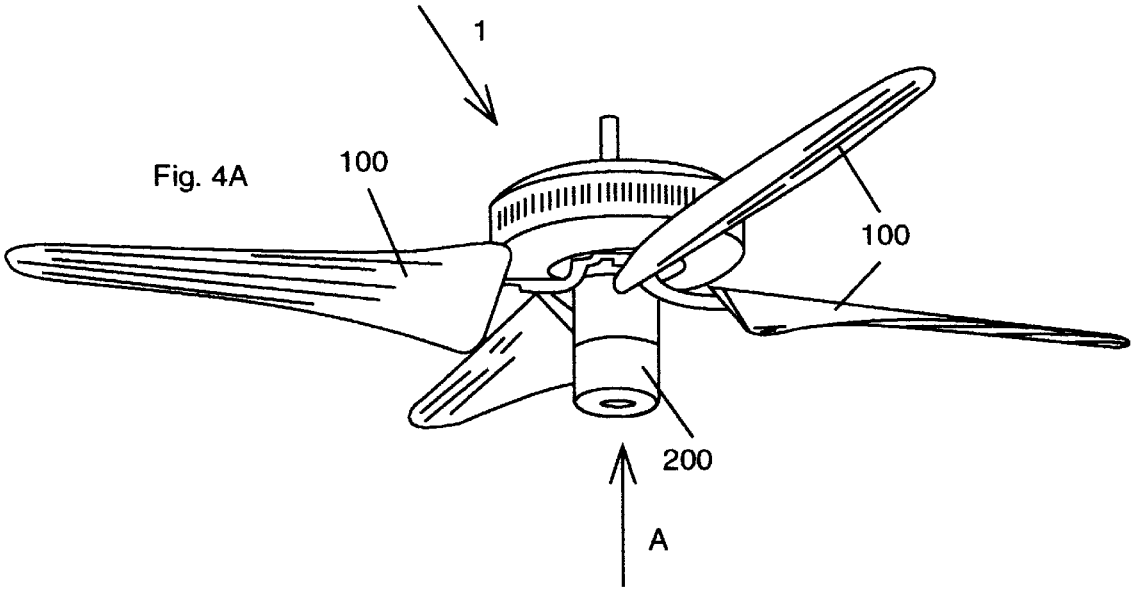
FIG. 4A is a perspective view of novel ceiling fan blades attached to a ceiling fan motor mount.
Figure 4C:
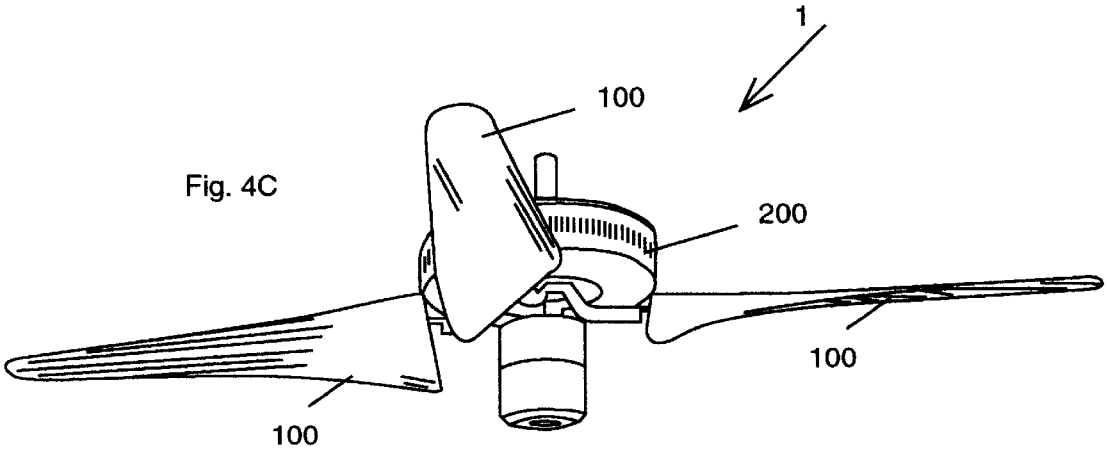
FIG. 4C is another perspective view of the novel fan blades and motor mount of FIG. 4A.
Figure 4D:
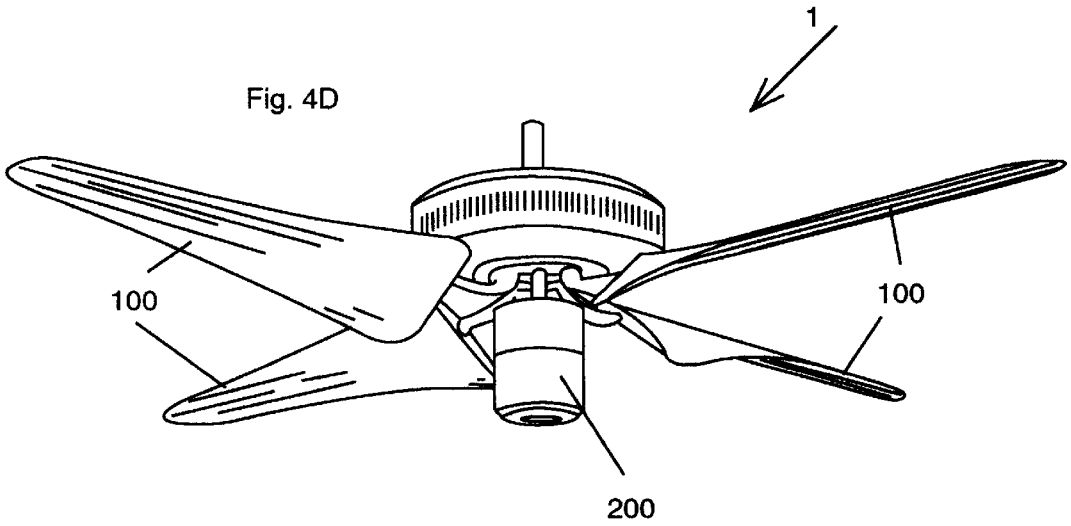
FIG. 4D is still another perspective view of the novel fan blades and motor mount of FIG. 4A.

FIG. 4A is a perspective view 1 of novel ceiling fan blades 100 attached to a ceiling fan motor mount 200. FIG. 4B is a bottom view of the novel fan blades 100 and motor mount 200 of FIG. 4A along arrow A. FIG. 4C is another perspective view of the novel fan blades 100 and motor mount 200 of FIG. 4A. FIG. 4D is still another perspective view of the novel fan blades 100 and motor mount 200 of FIG. 4A.

Figure 5A:
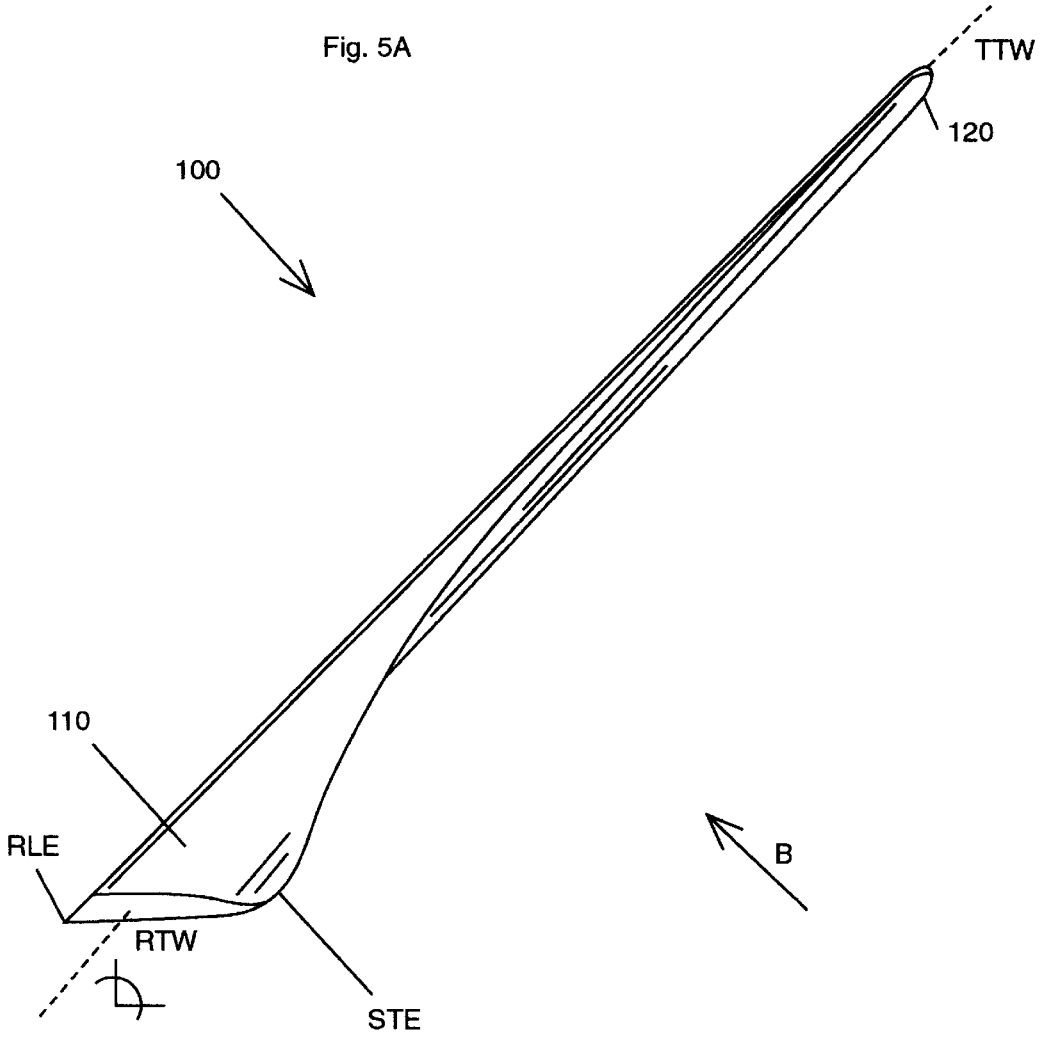
FIG. 5A is a perspective view of a single fan blade used in FIGS. 4A–4D.
Figure 5B:
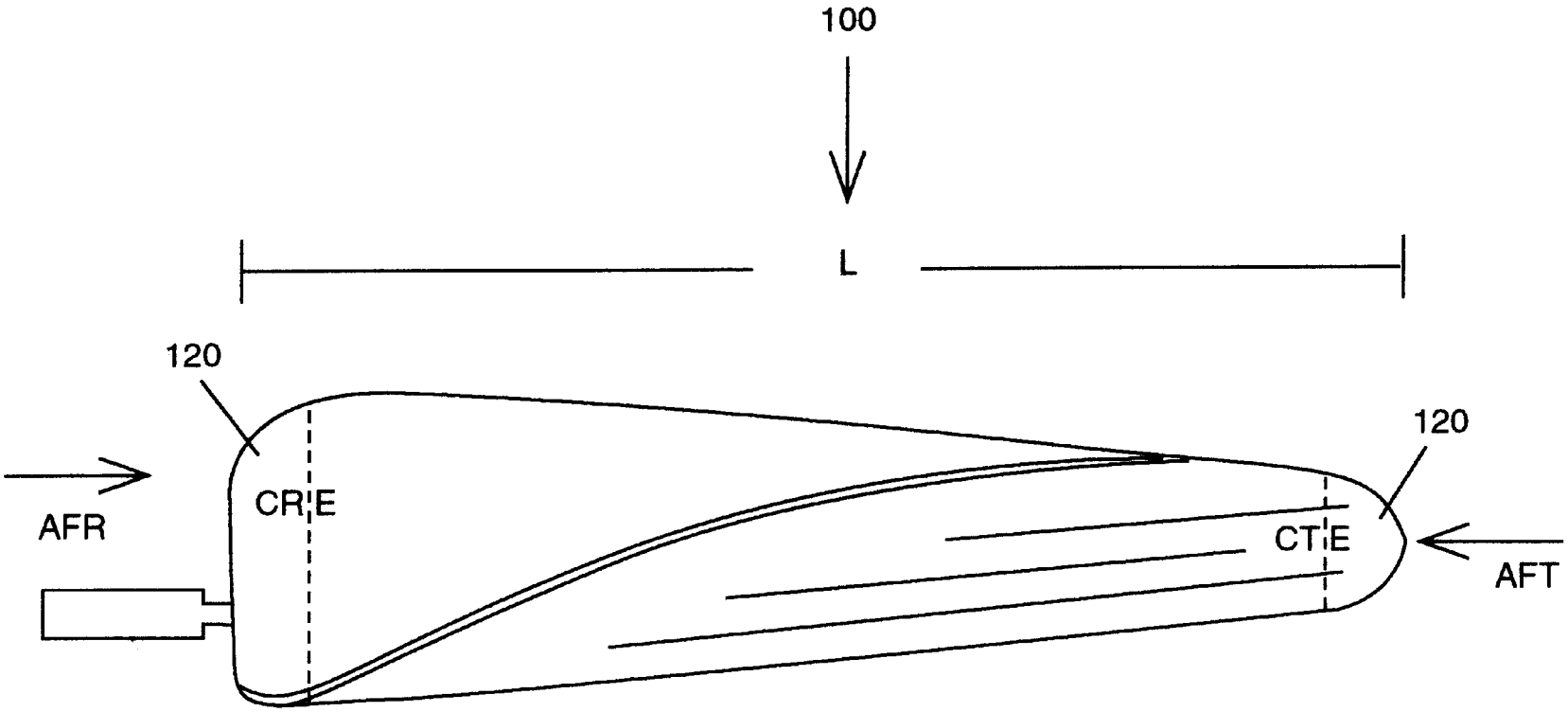
FIG. 5B is a bottom view of the single fan blade of FIG. 5A along arrow B.
Figure 5C:
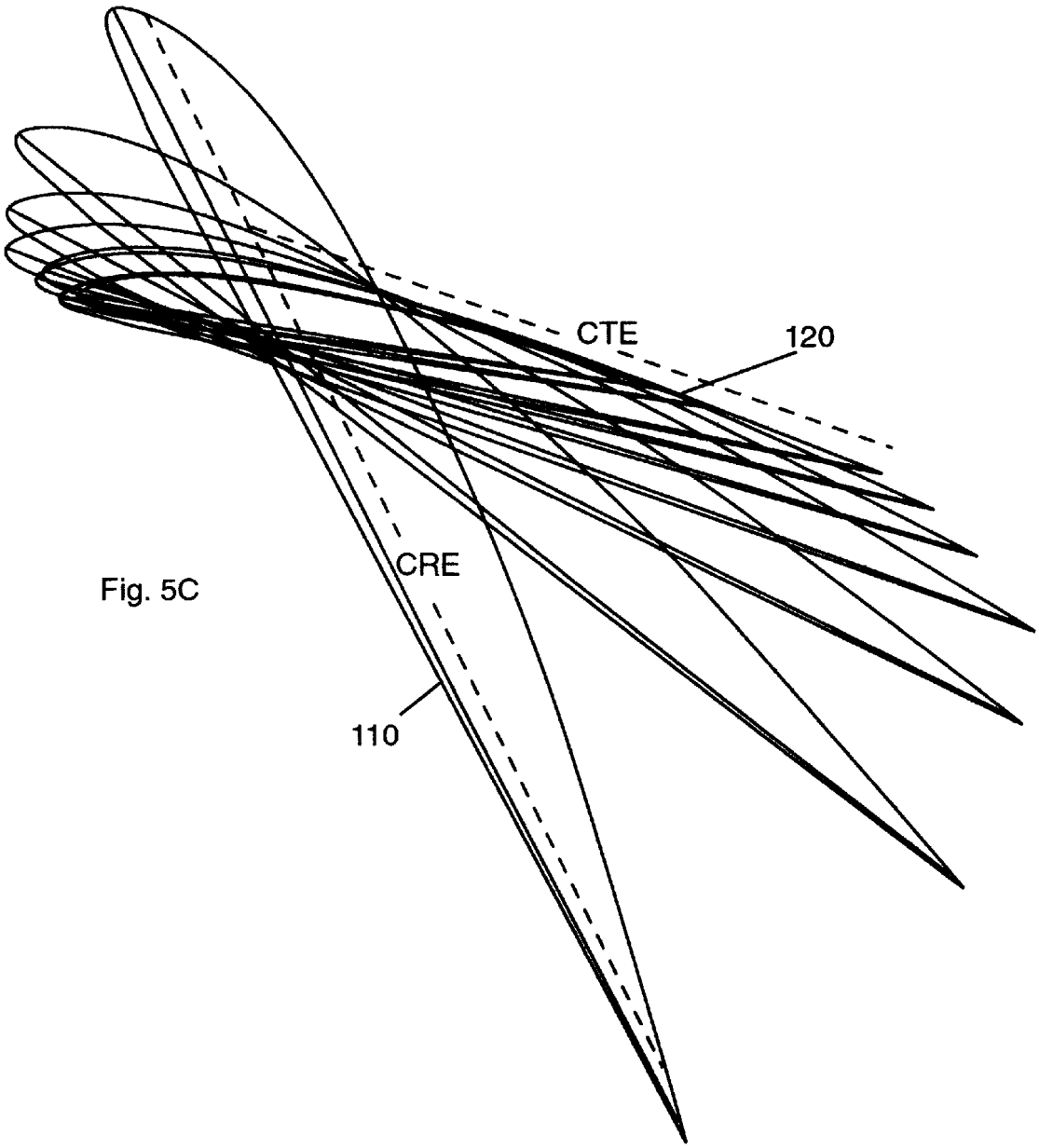
FIG. 5C shows the single fan blade represented by cross-sections showing the degrees of twist from the root end to the tip end.

FIG. 5A is a perspective view of the single fan blade 100 used in FIGS. 4A–4D. FIG. 5B is a bottom view of the single fan blade 100 of FIG. 5A along arrow B. Referring to FIGS. 5A–5B, fan blade 100 includes a flat faced root end 110 for being connected to the motor mount 200 of the preceding figures and an outer rounded tip end 120. Five embodiments of the novel invention are shown and described in reference to Table 5 as well as FIGS. 6A, 6B, 7A, 7B, 8A, 8B, 9A and 9B. Uniformally, the twist RTW in degrees at the root end of novel blade 100 is greater than the twist TTW at the tip end is shown in Table 5. Further in the each of the novel blade embodiments of blade 100, the chord tapers from the root end 110, CRE, to the tip end, CTE and is also shown in reference to Table 5. FIG. 5C shows the single fan blade represented by cross-sections showing the degrees of twist from the root end 110 to the tip end 120.

Table 5 shows the five versions of the novel subject invention blades that can be used with low speed ceiling fan operations. The CFlS (Short) was tested for FIGS. 1–3 described above.

TABLE 5

| | Blade | Root | | Tapered Chord | |
|---|---|---|---|---|---|
| Title | Length L in inches | Twist RTW in degrees | Tip Twist TTW in degrees | Root Edge CRE in inches | Tip Edge CTE in inches |
| CF1S | 20" | 26.7° | 6.9° | 6.0" | 2.0" |
| CF1L | 26" | 26.7° | 6.9° | 8.3" | 2.6" |
| CF2 | 20" | 38.0° | 6.2° | 8.4" | 7.5" |
| CF4 | 20" | 36.0° | 9.3° | 11.0" | 4.2" |
| CF5 | 20" | 32.8° | 5.1° | 5" | 5" |

Using TABLE 5, the degrees of the Root Twist and the Tip Twist are in the counter-clockwise direction looking at the blades from the root end to the tip end.

Four different Airfoils(SD7032, GM15, MA409, Hibbs504) can be used with each of the five blade versions of TABLE 5, and are shown in reference to FIGS. 6A–9B.

FIGS. 6A, 7A, 8A, and 9A show four various Airfoil dimensions AFR at the root end 110 of the blade 100. FIGS. 6B, 7B, 8B and 9B show the four various Airfoil dimensions, AFT for each of the four various Airfoils at the tip end 120 of the blade 100. AFR and AFT are shown in FIG. 5B.

TABLES 6, 7, 8, and 9 correspond to the respective airfoil coordinates: x/c, and y/c, for each of the four different Airfoils(SD7032, GM15, MA409, Hibbs504). These coordinates are given in a non-dimensional format, where x refers to the horizontal position, y refers to the vertical position and c is the chord length between the points CRE and CTE(shown in TABLE 5).

Figure 6A:
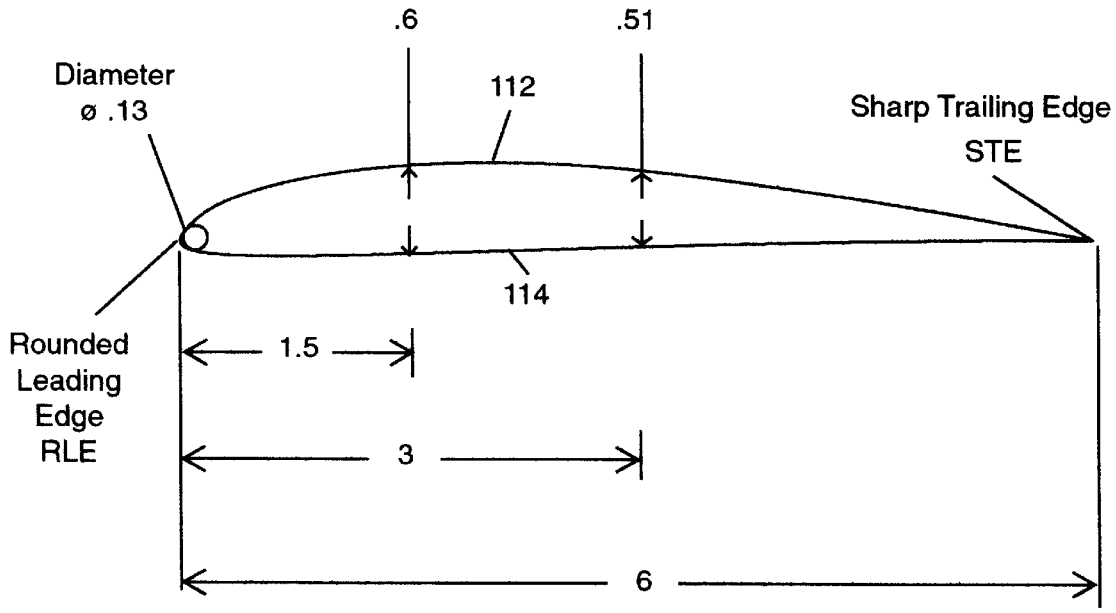
FIG. 6A is an end view along arrow AFR of the Airfoil at the root end of the blade of FIG. 5B for a first blade embodiment.
Figure 6B:
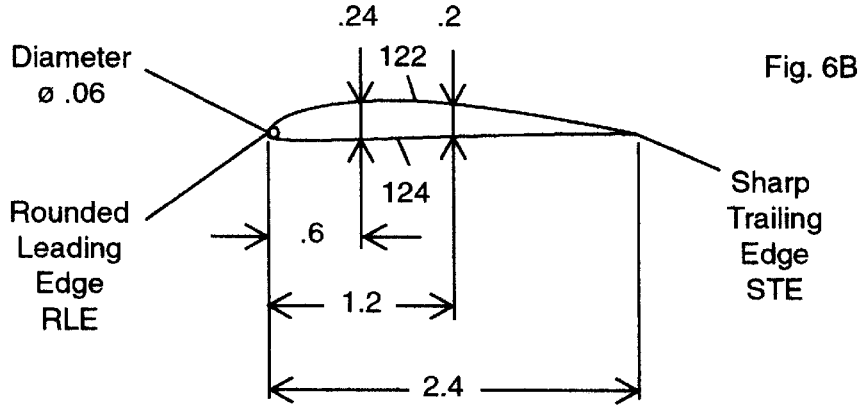
FIG. 6B is an end view along arrow AFT of the Airfoil at the tip end of the blade of FIG. 5B for the first blade embodiment.

FIG. 6A is an end view along arrow AFR of the Airfoil at the root end 110 of the blade 100 of FIG. 5B for a first blade embodiment. FIG. 6B is an end view along arrow AFT of the Airfoil at the tip end 120 of the blade 100 of FIG. 5B for the first blade embodiment. Referring to FIG. 6A, at the root of the fan blade, the rounded leading edge RLE moving in the direction of the rotating fan blade is rounded with a diameter of approximately 0.13", with upper surface 112 expanding in a slight convex shape to a height of 0.6" approximately 1.5" from RLE and curving downward to a height of 0.51" approximately 3" from RLE and finally curving downward to a sharp trailing edge, STE approximately 6" from RLE, with bottom surface 114 being slightly convex up to 1.5" from RLE and slightly concave adjacent to STE. Referring to FIG. 6B, at the tip of the fan blade, the leading edge RLE moving in the direction of the rotating fan blade is rounded with a diameter of approximately 0.06Δ, with upper surface 122 expanding in a slight convex shape to a height of 0.24" approximately 0.6" from RLE and curving downward to a height of 0.2" approximately 1.2" from RLE and finally curving downward to a sharp trailing edge, STE approximately 2.4" from RLE, with bottom surface 124 being slightly convex up to 0.6" from RLE and slightly convex adjacent to STE.

Figure 7A:
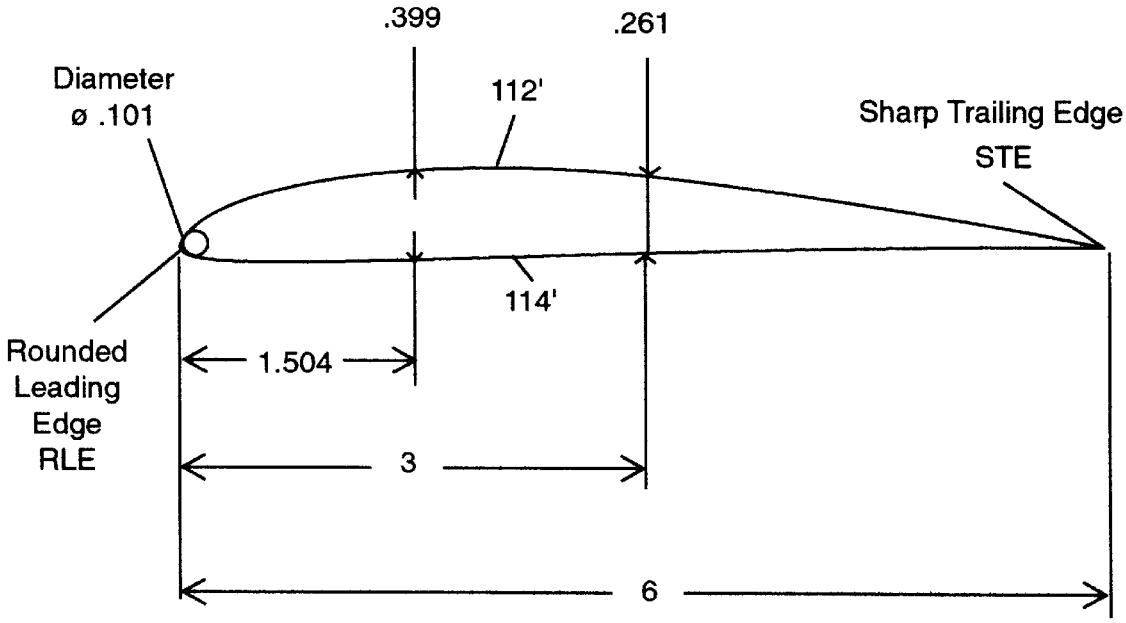
FIG. 7A is an end view along arrow AFR of the Airfoil at the root end of the blade of FIG. 5B for a second blade embodiment.
Figure 7B:
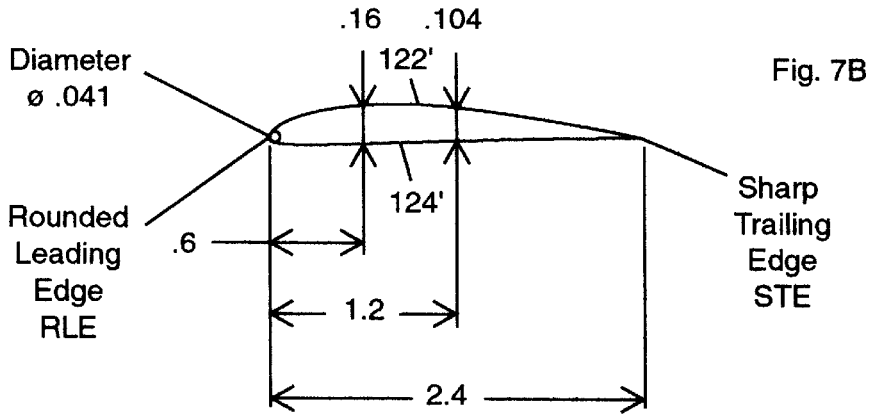
FIG. 7B is an end view along arrow AFT of the Airfoil at the tip end of the blade of FIG. 5B for the second blade embodiment.

FIG. 7A is an end view along arrow AFR of the Airfoil at the root end 110 of the blade 100 of FIG. 5B for a second blade embodiment. FIG. 7B is an end view along arrow AFT of the Airfoil at the tip end 120 of the blade 100 of FIG. 5B for the second blade embodiment. Referring to FIG. 7A, at the root of the fan blade, the leading edge RLE moving in the direction of the rotating fan blade is rounded with a diameter of approximately 0.101", with upper surface 112' expanding in a slight convex shape to a height of 0.399" approximately 1.504" from RLE and staying at the same planar level to a height of 0.261" approximately 3" from RLE and finally curving downward to a sharp trailing edge, STE approximately 6" from RLE, with bottom surface 114 being substantially convex approximately 1.504" from RLE and becoming concave to STE. Referring to FIG. 7B, at the tip of the fan blade, the leading edge RLE moving in the direction of the rotating fan blade is rounded with a diameter of approximately 0.041", with upper surface 122" expanding in a slight convex shape to a height of 0.16" approximately 0.6" from RLE staying at the same planar level to a height of 0.104" approximately 1.2" from RLE and finally curving downward to a sharp trailing edge, STE approximately 2.4" from RLE, with bottom surface 124' being convex being substantially convex approximately 0.6" from RLE and becoming concave to STE.

Figure 8A:
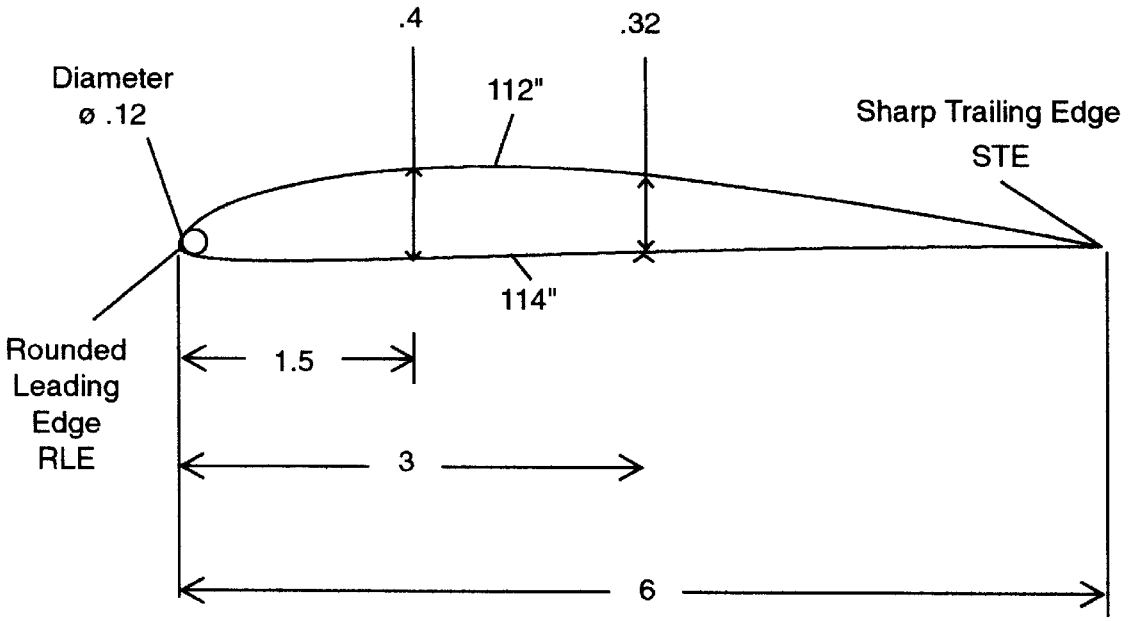
FIG. 8A is an end view along arrow AFR of the Airfoil at the root end of the blade of FIG. 5B for a third blade embodiment.
Figure 8B:
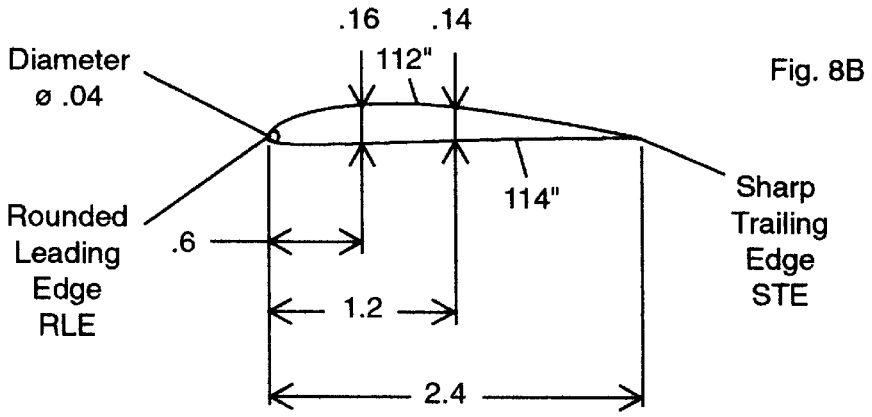
FIG. 8B is an end view along arrow AFT of the Airfoil at the tip end of the blade of FIG. 5B for the third blade embodiment.

FIG. 8A is an end view along arrow AFR of the Airfoil at the root end 110 of the blade 100 of FIG. 5B for a third blade embodiment. FIG. 8B is an end view along arrow AFT of the Airfoil at the tip end 120 of the blade 100 of FIG. 5B for the third blade embodiment. Referring to FIG. 8A, at the root of the fan blade, the leading edge RLE moving in the direction of the rotating fan blade is rounded with a diameter of approximately 0.12", with upper surface 112" expanding in a slight convex shape to a height of 0.4" approximately 1.5" from RLE and staying substantially planar to a height of 0.32" approximately 3" from RLE and finally curving downward to a sharp trailing edge, STE approximately 6" from RLE, with bottom surface 114" being slightly convex up to 1.5" from RLE and slightly concave to STE. Referring to FIG. 8B, at the tip of the fan blade, the leading edge RLE moving in the direction of the rotating fan blade is rounded with a diameter of approximately 0.04", with upper surface 122" expanding in a slight convex shape to a height of 0.16" approximately 0.6" from RLE and staying substantially planar to a height of 0.14" approximately 1.2" from RLE and finally curving downward to a sharp trailing edge, STE approximately 2.4" from RLE, with bottom surface 124" convex from RLE to 0.6" and concave to STE.

Figure 9A:
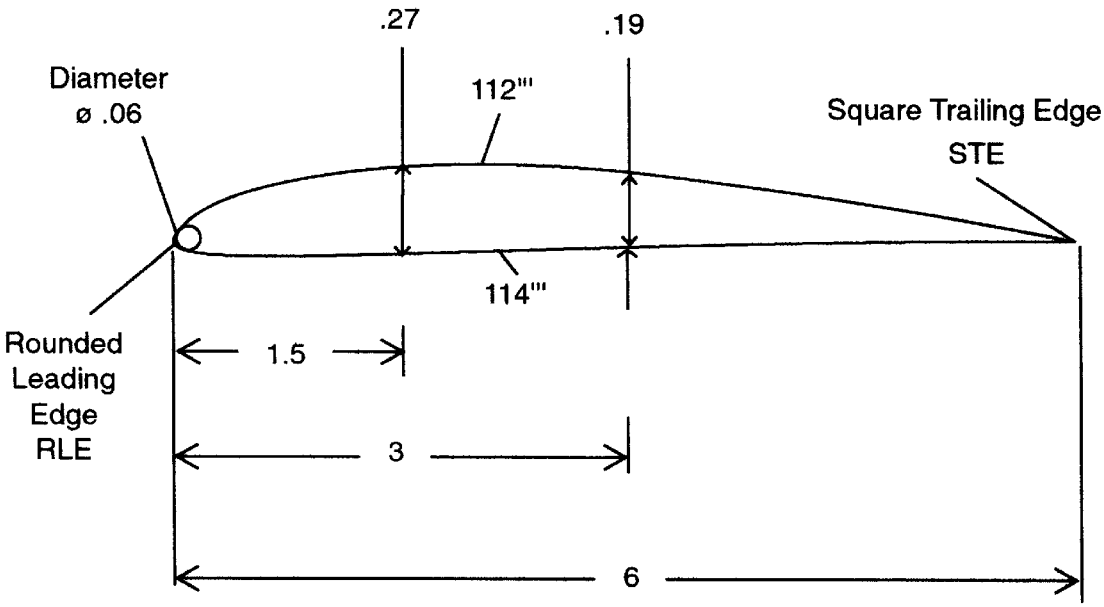
FIG. 9A is an end view along arrow AFR of the Airfoil at the root end of the blade of FIG. 5B for a fourth blade embodiment.
Figure 9B:
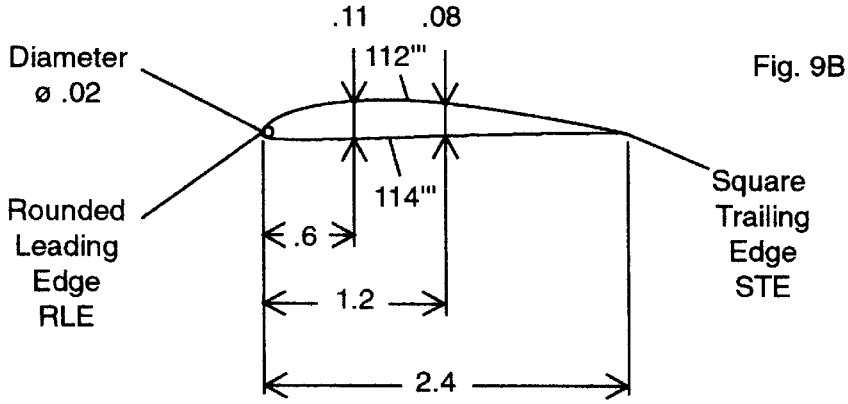
FIG. 9B is an end view along arrow AFT of the Airfoil at the tip end of the blade of FIG. 5B for the fourth blade embodiment.

FIG. 9A is an end view along arrow AFR of the Airfoil at the root end 110 of the blade 100 of FIG. 5B for a fourth blade embodiment. FIG. 9B is an end view along arrow AFT of the Airfoil at the tip end 120 of the blade 100 of FIG. 5B for the fourth blade embodiment. Referring to FIG. 9A, at the root of the fan blade, the leading edge RLE moving in the direction of the rotating fan blade is rounded with a diameter of approximately 0.06", with upper surface 112'" expanding in a slight convex shape to a height of 0.27" approximately 1.5" from RLE staying substantially planar to a height of 0.19" approximately 3" from RLE and finally slightly curving downward to a square trailing edge, STE approximately 6" from RLE, with bottom surface 114'" convex 1.5" from RLE and concave to STE. Referring to FIG. 9B, at the tip of the fan blade, the leading edge RLE moving in the direction of the rotating fan blade is rounded with a diameter of approximately 0.02", with upper surface 122'" expanding in a slight convex shape to a height of 0.11" approximately 0.6" from RLE staying substantially planar to a height of 0.08" approximately 1.2" from RLE and finally curving downward to a square trailing edge, STE approximately 2.4" from RLE, with bottom surface 124'" being convex 0.6" from RLE and concave to STE.

TABLE 6

| SD7032 Airfoil Coordinate | |
|---|---|
| x/c | y/c |
| 1.00000 | 0.00000 |
| 0.99674 | 0.00048 |
| 0.98712 | 0.00204 |
| 0.97155 | 0.00485 |
| 0.95054 | 0.00894 |
| 0.92464 | 0.01420 |
| 0.89436 | 0.02041 |
| 0.86021 | 0.02731 |
| 0.82264 | 0.03460 |
| 0.78208 | 0.04199 |
| 0.73892 | 0.04925 |
| 0.69356 | 0.05620 |
| 0.64646 | 0.06270 |
| 0.59812 | 0.06861 |
| 0.54902 | 0.07381 |
| 0.49967 | 0.07816 |
| 0.45058 | 0.08154 |
| 0.40222 | 0.08385 |
| 0.35506 | 0.08500 |
| 0.30953 | 0.08493 |
| 0.26604 | 0.08359 |
| 0.22499 | 0.08096 |
| 0.18671 | 0.07703 |
| 0.15146 | 0.07182 |
| 0.11948 | 0.06548 |
| 0.09105 | 0.05809 |
| 0.06627 | 0.04976 |
| 0.04524 | 0.04078 |
| 0.02812 | 0.03145 |
| 0.01502 | 0.02206 |
| 0.00606 | 0.01293 |
| 0.00115 | 0.00448 |
| 0.00038 | −0.00223 |
| 0.00532 | −0.00701 |
| 0.01649 | −0.01088 |
| 0.03308 | −0.01403 |
| 0.05491 | −0.01635 |
| 0.08180 | −0.01787 |
| 0.11351 | −0.01862 |
| 0.14974 | −0.01867 |
| 0.19010 | −0.01810 |
| 0.23420 | −0.01699 |
| 0.28153 | −0.01547 |
| 0.33154 | −0.01363 |
| 0.38364 | −0.01152 |
| 0.43724 | −0.00922 |
| 0.49176 | −0.00678 |
| 0.54659 | −0.00430 |
| 0.60112 | −0.00190 |
| 0.65469 | 0.00030 |
| 0.70664 | 0.00224 |
| 0.75634 | 0.00379 |
| 0.80313 | 0.00485 |
| 0.84635 | 0.00535 |
| 0.88534 | 0.00526 |
| 0.91942 | 0.00458 |
| 0.94797 | 0.00350 |
| 0.97054 | 0.00226 |
| 0.98684 | 0.00113 |

TABLE 6-continued

| SD7032 Airfoil Coordinate | |
|---|---|
| x/c | y/c |
| 0.99670 | 0.00030 |
| 1.00000 | 0.00000 |

TABLE 7

| GM15 Airfoil Coordinate | |
|---|---|
| x/c | y/c |
| 1.00000 | −0.00153 |
| 0.99539 | 0.00116 |
| 0.98862 | 0.00264 |
| 0.98057 | 0.00402 |
| 0.97155 | 0.00594 |
| 0.95658 | 0.00878 |
| 0.94418 | 0.01143 |
| 0.93171 | 0.01364 |
| 0.91581 | 0.01630 |
| 0.89757 | 0.01997 |
| 0.88410 | 0.02301 |
| 0.85174 | 0.02964 |
| 0.82229 | 0.03442 |
| 0.79060 | 0.03884 |
| 0.74898 | 0.04494 |
| 0.70735 | 0.05047 |
| 0.66514 | 0.05535 |
| 0.62046 | 0.05914 |
| 0.56279 | 0.06420 |
| 0.51025 | 0.06836 |
| 0.45558 | 0.07133 |
| 0.39572 | 0.07301 |
| 0.33961 | 0.07258 |
| 0.28096 | 0.07109 |
| 0.23556 | 0.06865 |
| 0.18840 | 0.06385 |
| 0.15957 | 0.05955 |
| 0.13405 | 0.05505 |
| 0.10701 | 0.04930 |
| 0.09233 | 0.04536 |
| 0.07702 | 0.04098 |
| 0.06153 | 0.03601 |
| 0.05063 | 0.03216 |
| 0.04017 | 0.02804 |
| 0.02829 | 0.02250 |
| 0.02132 | 0.01883 |
| 0.01500 | 0.01537 |
| 0.00842 | 0.01098 |
| 0.00385 | 0.00725 |
| 0.00167 | 0.00406 |
| 0.00000 | −0.00011 |
| 0.00399 | −0.00628 |
| 0.00781 | −0.00744 |
| 0.01570 | −0.00888 |
| 0.02268 | −0.01002 |
| 0.03116 | −0.01102 |
| 0.04716 | −0.01198 |
| 0.06033 | −0.01208 |
| 0.07504 | −0.01193 |
| 0.08895 | −0.01171 |
| 0.10477 | −0.01108 |
| 0.12022 | −0.01004 |
| 0.14641 | −0.00794 |
| 0.17578 | −0.00523 |
| 0.20395 | −0.00226 |
| 0.24788 | 0.00282 |
| 0.29626 | 0.00853 |
| 0.34919 | 0.01424 |
| 0.40288 | 0.01903 |
| 0.46307 | 0.02355 |
| 0.51862 | 0.02613 |
| 0.57584 | 0.02678 |
| 0.63110 | 0.02605 |

TABLE 7-continued

| GM15 Airfoil Coordinate | |
|---|---|
| x/c | y/c |
| 0.67619 | 0.02462 |
| 0.72014 | 0.02343 |
| 0.76444 | 0.02159 |
| 0.80748 | 0.01935 |
| 0.83766 | 0.01578 |
| 0.86986 | 0.01314 |
| 0.90304 | 0.00973 |
| 0.91751 | 0.00771 |
| 0.93202 | 0.00616 |
| 0.95024 | 0.00412 |
| 0.96279 | 0.00217 |
| 0.97394 | 0.00103 |
| 0.98610 | −0.00010 |
| 0.99283 | −0.00114 |
| 1.00000 | −0.00153 |

TABLE 8

| MA409 Airfoil Coordinate | |
|---|---|
| x/c | y/c |
| 1.00000 | −0.00018 |
| 0.99720 | 0.00043 |
| 0.99175 | 0.00133 |
| 0.98504 | 0.00240 |
| 0.97808 | 0.00336 |
| 0.97095 | 0.00424 |
| 0.96274 | 0.00536 |
| 0.95052 | 0.00716 |
| 0.94205 | 0.00843 |
| 0.92669 | 0.01072 |
| 0.91083 | 0.01322 |
| 0.89909 | 0.01491 |
| 0.86881 | 0.01946 |
| 0.84319 | 0.02298 |
| 0.81288 | 0.02684 |
| 0.77221 | 0.03143 |
| 0.72759 | 0.03588 |
| 0.67018 | 0.04107 |
| 0.61345 | 0.04551 |
| 0.55514 | 0.04947 |
| 0.49831 | 0.05310 |
| 0.44066 | 0.05540 |
| 0.38248 | 0.05684 |
| 0.33651 | 0.05671 |
| 0.29551 | 0.05636 |
| 0.25040 | 0.05530 |
| 0.21036 | 0.05254 |
| 0.17822 | 0.04967 |
| 0.14297 | 0.04628 |
| 0.11363 | 0.04257 |
| 0.09503 | 0.03950 |
| 0.08197 | 0.03694 |
| 0.06768 | 0.03368 |
| 0.05445 | 0.03018 |
| 0.04538 | 0.02745 |
| 0.03432 | 0.02377 |
| 0.02440 | 0.01984 |
| 0.01444 | 0.01477 |
| 0.00787 | 0.01033 |
| 0.00213 | 0.00509 |
| 0.00043 | 0.00228 |
| 0.00055 | −0.00262 |
| 0.00328 | −0.00600 |
| 0.00830 | −0.00907 |
| 0.01423 | −0.01167 |
| 0.01996 | −0.01369 |
| 0.02550 | −0.01504 |
| 0.03360 | −0.01635 |
| 0.04220 | −0.01731 |
| 0.05421 | −0.01795 |

TABLE 8-continued

| MA409 Airfoil Coordinate | |
|---|---|
| x/c | y/c |
| 0.06552 | −0.01827 |
| 0.08973 | 0.01834 |
| 0.10067 | −0.01821 |
| 0.11201 | −0.01798 |
| 0.13732 | −0.01725 |
| 0.16378 | −0.01619 |
| 0.19399 | −0.01505 |
| 0.23873 | −0.01281 |
| 0.28061 | −0.01034 |
| 0.33952 | −0.00702 |
| 0.39707 | −0.00433 |
| 0.45727 | −0.00184 |
| 0.51627 | −0.00082 |
| 0.57355 | −0.00006 |
| 0.62624 | 0.00021 |
| 0.67937 | 0.00048 |
| 0.72125 | 0.00013 |
| 0.76715 | −0.00014 |
| 0.81282 | −0.00015 |
| 0.84246 | −0.00012 |
| 0.87766 | −0.00015 |
| 0.91173 | −0.00071 |
| 0.92537 | −0.00084 |
| 0.94213 | −0.00111 |
| 0.95522 | −0.00122 |
| 0.96880 | −0.00129 |
| 0.97824 | −0.00111 |
| 0.98517 | −0.00084 |
| 0.99321 | −0.00043 |
| 1.00000 | −0.00018 |

TABLE 9

| Hibbs504 Airfoil Coordinate | |
|---|---|
| x/c | y/c |
| 1.00000 | 0.00250 |
| 0.99901 | 0.00276 |
| 0.99606 | 0.00336 |
| 0.99114 | 0.00420 |
| 0.98429 | 0.00518 |
| 0.97553 | 0.00628 |
| 0.96489 | 0.00748 |
| 0.95241 | 0.00902 |
| 0.93815 | 0.01075 |
| 0.92216 | 0.01252 |
| 0.90451 | 0.01433 |
| 0.88526 | 0.01615 |
| 0.86448 | 0.01798 |
| 0.84227 | 0.01982 |
| 0.81871 | 0.02166 |
| 0.79389 | 0.02348 |
| 0.76791 | 0.02528 |
| 0.74088 | 0.02705 |
| 0.71289 | 0.02878 |
| 0.68406 | 0.03044 |
| 0.65451 | 0.03205 |
| 0.62435 | 0.03356 |
| 0.59369 | 0.03498 |
| 0.56267 | 0.03629 |
| 0.53140 | 0.03749 |
| 0.50000 | 0.03853 |
| 0.46861 | 0.03944 |
| 0.43733 | 0.04019 |
| 0.40631 | 0.04078 |
| 0.37566 | 0.04118 |
| 0.34549 | 0.04136 |
| 0.31594 | 0.04133 |
| 0.28711 | 0.04106 |
| 0.25912 | 0.04059 |
| 0.23209 | 0.03988 |

TABLE 9-continued

| Hibbs504 Airfoil Coordinate | |
|---|---|
| x/c | y/c |
| 0.20611 | 0.03894 |
| 0.18129 | 0.03775 |
| 0.15773 | 0.03626 |
| 0.13552 | 0.03448 |
| 0.11474 | 0.03240 |
| 0.09549 | 0.03005 |
| 0.07784 | 0.02745 |
| 0.06185 | 0.02463 |
| 0.04759 | 0.02166 |
| 0.03511 | 0.01859 |
| 0.02447 | 0.01539 |
| 0.01571 | 0.01210 |
| 0.00886 | 0.00879 |
| 0.00394 | 0.00558 |
| 0.00099 | 0.00259 |
| 0 | 0 |
| 1.00000 | −0.00250 |
| 0.99901 | −0.00224 |
| 0.99606 | −0.00164 |
| 0.99114 | −0.00080 |
| 0.98429 | 0.00018 |
| 0.97553 | 0.00128 |
| 0.96489 | 0.00248 |
| 0.95241 | 0.00349 |
| 0.93815 | 0.00436 |
| 0.92216 | 0.00524 |
| 0.90451 | 0.00611 |
| 0.88526 | 0.00693 |
| 0.86448 | 0.00770 |
| 0.84227 | 0.00838 |
| 0.81871 | 0.00897 |
| 0.79389 | 0.00943 |
| 0.76791 | 0.00975 |
| 0.74088 | 0.00994 |
| 0.71289 | 0.00998 |
| 0.68406 | 0.00987 |
| 0.65451 | 0.00963 |
| 0.62435 | 0.00923 |
| 0.59369 | 0.00870 |
| 0.56267 | 0.00803 |
| 0.53140 | 0.00722 |
| 0.50000 | 0.00627 |
| 0.46861 | 0.00524 |
| 0.43733 | 0.00409 |
| 0.40631 | 0.00286 |
| 0.37566 | 0.00157 |
| 0.34549 | 0.00028 |
| 0.31594 | −0.00105 |
| 0.28711 | −0.00234 |
| 0.25912 | −0.00365 |
| 0.23209 | −0.00490 |
| 0.20611 | −0.00608 |
| 0.18129 | −0.00717 |
| 0.15773 | −0.00812 |
| 0.13552 | −0.00886 |
| 0.11474 | −0.00940 |
| 0.09549 | −0.00971 |
| 0.07784 | −0.00979 |
| 0.06185 | −0.00967 |
| 0.04759 | −0.00934 |
| 0.03511 | −0.00881 |
| 0.02447 | −0.00801 |
| 0.01571 | −0.00692 |
| 0.00886 | −0.00555 |
| 0.00394 | −0.00394 |
| 0.00099 | −0.00211 |
| 0 | 0 |

Although the CFlS(Short) shown in TABLE 5 was tested for FIGS. 1–3 described above, all the other blade versions would be expected to have similar results, with the CFlL (Long) expected to probably yield the most optimum results.

All of the invention blade models have larger rounded trailing edges and narrower rounded leading edges.

The novel subject invention fan blades can be manufactured by injection molded plastic and can be sold for approximately $30 to approximately $60.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A ceiling fan blade for low speed operation at approximately 50 to approximately 200 revolutions per minute(rpm) for use in overhead ceiling fan systems, the blade comprising:

a positive twist adjacent to a rotor end of the blade, so that blade pitch increases from a tip end of the blade to the rotor end of the blade;

an airfoil having a thicker portion at the rotor end tapering down to a thinner portion at the tip end, for providing high lift and low drag; and a blade chord having a wider portion from the rotor end tapering down to a narrower portion at the tip end, wherein the blade is operated in a ceiling fan running at low speed ranges of approximately 50 to approximately 200 revolutions per minute(rpm) for use with ceiling fan systems, and provides substantial energy savings and increased air flow over conventional ceiling blades.

2. The ceiling fan blade of claim 1, further comprising:

a second blade, a third blade and a fourth blade, each having:

a positive twist, so that pitch increases from a tip end of each blade to the rotor end;

an airfoil having a thicker portion at the rotor end tapering down to a thinner portion at the tip end, providing high lift and low drag; and a tapered blade having a wider portion from the rotor end tapering down to a narrower portion at the tip end, wherein each of the blades operates in a ceiling fan running at approximately 50 to approximately 200 rpm.

3. The ceiling fan blade of claim 1, wherein the positive twist includes:

a blade root twist adjacent the rotor end of approximately 25 to approximately 40 degrees; and a blade tip twist adjacent the tip end of approximately 5 to approximately 11 degrees.

4. The ceiling fan blade of claim 3, wherein the blade chord includes:

a root edge having a width of greater than approximately five inches; and a tip edge having a width of less than approximately five inches.

5. The ceiling fan blade of claim 4, wherein the blade includes a length of:

approximately 20 inches.

6. The ceiling fan blade of claim 4, wherein the blade includes a length of:

approximately 26 inches.

7. The ceiling fan blade of claim 3, wherein the airfoil includes:

a root edge portion having a first thickness portion of approximately 0.19 to approximately 0.6 inches; and a tip edge portion having a second thickness portion of approximately 0.08 to approximately 0.24 inches.

8. The ceiling fan blade of claim 7, wherein the blade includes a length of:

approximately 20 inches.

9. The ceiling fan blade of claim 7, wherein the blade includes a length of:

approximately 26 inches.

10. The ceiling fan blade of claim 1, wherein the airfoil further includes:

a rounded leading edge; and a sharp trailing edge.

11. The ceiling fan blade of claim 1, wherein the airfoil further includes:

a rounded leading edge; and a nonrounded trailing edge.

12. The ceiling fan blade of claim 1, wherein the airfoil further includes:

an upper surface being substantially convex; and a lower surface having a convex portion adjacent to a leading edge, side-by-side to a concave portion adjacent to a trailing edge.

13. The ceiling fan blade of claim 1, wherein the chord further includes:

a width of approximately 5 to approximately 7 inches at the root end of the blade; and a width of approximately 2 to approximately 3 inches at the tip end of the blade.

14. An overhead ceiling fan system for low speed operation at approximately 50 to approximately 200 revolutions per minute(rpm), comprising in combination:

a ceiling fan motor for being attached to a ceiling; and ceiling fan blades being attached to the ceiling fan motor, each blade includes:

a positive twist adjacent to a rotor end of the blade of approximately 25 to approximately 50 degrees;

a second positive twist adjacent to a tip end of the blade of approximately 5 to approximately 10 degrees, so that the blade pitch increases from the tip end to the rotor end of the blade;

a chord component having a first width portion of approximately 5 to approximately 11 inches adjacent to the rotor end of the blade, and a second width portion of approximately 2 to approximately 5 inches adjacent to the tip end; and an airfoil component portion having a first thickness portion of approximately 0.19 to approximately 0.6 inches adjacent to the rotor end of the blade tapering down to a second thickness portion of approximately 0.08 to approximately 0.24 inches adjacent to the tip end, wherein the ceiling fan motor runs at low speed ranges of approximately 50 to approximately 200; revolutions per minute(rpm), providing substantial energy savings and increased air flow.

15. A method for operating an overhead ceiling fan system comprising the steps of:

(a) rotating fan blades attached to a ceiling fan at a speed range of approximately 50 to approximately 200 revolutions per minute(rpm);

(b) drawing a power supply of less than approximately 50 Watts; and (c) generating a downward airflow of up to approximately 6500 CFM from the rotating blades, wherein the ceiling fan system reduces power consumption and enhances axial air flow.

16. The method for operating the overhead ceiling fan system of claim 15, wherein each of the fan blades include:

a positive twist adjacent to a rotor end of the blade, so that blade pitch increases from a tip end of the blade to the rotor end of the blade;

an airfoil having a thicker portion at the rotor end tapering down to a thinner portion at the tip end, for providing high lift and low drag; and a blade chord having a first width portion wider portion at the rotor end and a second width portion at the tip end, the first width portion being at least as wide as the second width portion at the tip end.

* * * * *